US008513896B2

(12) United States Patent
Grebner

(10) Patent No.: US 8,513,896 B2
(45) Date of Patent: Aug. 20, 2013

(54) METHOD AND CIRCUIT ARRANGEMENT FOR CONTROLLING A LOAD

(75) Inventor: Klaus-Dieter Grebner, Markt Rodach (DE)

(73) Assignee: Lear Corporation GmbH, Ginsheim-Gustavsberg (DE)

( * ) Notice: Subject to any disclaimer, the term of this patent is extended or adjusted under 35 U.S.C. 154(b) by 290 days.

(21) Appl. No.: 12/786,016

(22) Filed: May 24, 2010

(65) Prior Publication Data

US 2011/0285317 A1 Nov. 24, 2011

(30) Foreign Application Priority Data

May 6, 2009 (DE) ..... 10 2009 025 752

(51) Int. Cl.
*H05B 37/02* (2006.01)

(52) U.S. Cl.
USPC ..... 315/291; 315/247; 315/307

(58) Field of Classification Search
USPC ..... 315/185 R, 186, 247, 291, 307, 312
See application file for complete search history.

(56) References Cited

U.S. PATENT DOCUMENTS

| | | | | |
|---|---|---|---|---|
| 7,425,943 | B2 * | 9/2008 | Furukawa | 345/102 |
| 2006/0038512 | A1 * | 2/2006 | Tani | 315/291 |
| 2006/0244396 | A1 * | 11/2006 | Bucur | 315/312 |
| 2008/0191642 | A1 * | 8/2008 | Slot et al. | 315/295 |
| 2008/0203946 | A1 * | 8/2008 | Ito et al. | 315/307 |
| 2009/0179575 | A1 * | 7/2009 | Mednik et al. | 315/193 |
| 2009/0251065 | A1 | 10/2009 | Niedermeier et al. | |
| 2010/0013411 | A1 | 1/2010 | Krespach et al. | |
| 2012/0104974 | A1 * | 5/2012 | Saes et al. | 315/297 |

FOREIGN PATENT DOCUMENTS

DE 20 2007 011 97 U1 1/2009

* cited by examiner

*Primary Examiner* — Tung X Le
(74) *Attorney, Agent, or Firm* — MacMillan, Sobanski & Todd, LLC

(57) ABSTRACT

A method for control and discharge control of an electrical load, in which the control and discharge occurs by means of a control frame and a discharge frame, and in which one control frame and one discharge frame represent one switching cycle for the electrical load. A plurality of switching cycles are arranged following one another, wherein a controllable switch is connected in parallel to each point load so that each point load can be switched independently of the other point load during the switching cycle. A control unit monitors the electrical current flowing in the electrical load, and the control unit uses an actual/setpoint comparison to control the current to an adjustable setpoint so that a current that is as constant as possible flows into the electrical load. The controllable switches switch on the point loads during the control frame of a switching cycle, and the controllable switches switch off the point loads during the discharge frame of a switching cycle.

24 Claims, 13 Drawing Sheets

METHOD AND CIRCUIT ARRANGEMENT FOR CONTROLLING A LOAD

BACKGROUND OF THE INVENTION

The present invention relates to a method and circuit arrangement for controlling an electrical load. The controlled electrical load particularly relates to an arrangement of light-emitting diodes, hereinafter called LEDs, wherein the electrical load is to be supplied with a nearly constant operating current.

Constant-current sources are primarily used to control an electrical load, especially a load of LEDs, LED chains and/or LED arrays. Diverse arrangements of LEDs are known; besides parallel and matrix connection of LEDs, the possibility of series connection of LEDs is known. In a series connection of LEDs, all LEDs are connected behind one another in a row; this connection is also called an LED chain. In order to operate LED chains, a constant current is generated and conducted through the LEDs. A voltage that corresponds to the sum of the forward voltages of all LEDs then appears across the LEDs.

To achieve a constant luminous efficacy, the current that flows through the LEDs must therefore be controlled in a temperature-dependent manner and nearly constant. This is achieved in a known manner using pulse width modulation of the supplied current. This modulated current is then used for brightness control of the LED chain by means of pulse width modulation.

The energy supply of the LEDS is accomplished, for example, by means of a step-up converter. Such a step-up converter is considered state of the art.

An LED cluster arrangement that is supplied with constant current is known from DE 20 2007 011 973 U1. The LED cluster arrangement is controlled by pulse width modulation.

DE 2006 059 355 A1 discloses a control device in a method for operating a series connection of light-emitting diodes.

DE 10 2005 058 484 A1 discloses a circuit arrangement and a method for operating at least one LED.

Problematic in the known state of the art, however, is the fact that there exist various control possibilities for electrical loads consisting of individual point loads or partial loads, especially LEDs. Problematic above all in this case is that the voltage varies as a function of the number of controlled and connected point loads or partial loads. In particular, if the partial loads are switched on or off, then the output capacitance, which is used for smoothing the voltage over the electrical load, should be discharged before rewiring and switching on the loads so that a discharge of the output capacitance will then not occur through the partial loads that are still closed and thereby possibly damage them.

SUMMARY OF THE INVENTION

The object of the present invention is to provide a method and a device that handle this problem and, in a special embodiment, point out a possibility for saving energy during the discharge of the output capacitance.

The present object is achieved on the basis of the characteristics of the claimed invention. Advantageous embodiments of the invention arise on the basis of the dependent claims and a concrete embodiment example based on a concrete circuit arrangement and device.

A method for control and discharge control of an electrical load in which the control and discharge occurs by means of a control frame and a discharge frame and in which one control frame and one discharge frame represent one switching cycle for the electrical load will be shown. A plurality of switching cycles are arranged following one another, wherein a controllable switch is connected in parallel to each point load so that each point load can be switched independently of the other point load during the switching cycle. A control unit monitors the electrical current flowing in the electrical load, and the control unit uses an actual/setpoint comparison to control the current to an adjustable setpoint, so that a current that is as constant as possible flows into the electrical load. The controllable switches switch on the point loads during the control frame of a switching cycle, and the controllable switches switch off the point loads during the discharge frame of a switching cycle.

It is advantageous that the point loads are individually switched on or off in succession or together or in groups and/or that the point loads are connected in series. The electrical load can be individually controlled in this way.

In one embodiment, a diode array, which comprises at least two light-emitting diodes connected in parallel and/or in series and/or matrix-connected, forms a point load. As an alternative, it is provided that one light-emitting diode is a point load. An adjustment can thus be made to each requirement on the light-emitting diodes and the electrical load.

It is advantageous that a capacitor connected in parallel to the electrical load smoothes the voltage dropping across the electrical load, wherein a discharge resistor with an additional controllable switch is connected in parallel to the capacitor in order to discharge the capacitor during the discharge frame by closing the additional controllable switch to ground or to zero point or to another voltage potential through the discharge resistor. In this case it is advantageous that discharge of the capacitor does not occur through the electrical load and its point loads, but that the discharge occurs directly through the discharge resistor to ground or to zero point or to another voltage potential. This prevents the discharge process from damaging or overloading or overcharging the electrical load or one of the point loads.

It is advantageous that an input capacitor, which is connected in parallel to the electrical load and control unit, is connected to the capacitor by a discharge resistor and an additional controllable switch, so that the discharge of the capacitor occurs into the input capacitor when the additional controllable switch is closed, thereby increasing the input voltage. In this case it is advantageous that the discharge of the capacitor does not occur through the electrical load and its point loads, but that the discharge occurs directly through the discharge resistor. This prevents the discharge process from damaging or overloading the electrical load or one of the point loads. In addition, the energy stored in the capacitor is not annihilated during the discharge by discharging the capacitor to ground or to zero point or to another voltage potential, rather the energy is transmitted to the input capacitor and can be used for the next switching cycle. This leads to better efficiency.

It is advantageous that an input capacitor, which is connected in parallel to the electrical load and control unit, is connected to the capacitor by a discharge inductor and an additional controllable switch, so that the discharge of the capacitor occurs into the input inductor and input capacitor when the additional controllable switch is closed, thereby increasing an input voltage. In this case it is advantageous that the discharge of the capacitor does not occur through the electrical load and its point loads, but that the discharge occurs directly through the discharge inductor into the input capacitor. This prevents the discharge process from damaging or overloading the electrical load or one of the point loads. In addition, the energy stored in the capacitor is not annihilated during the discharge by discharging the capacitor to ground or to zero point or to another voltage potential, rather the energy is transmitted to the input capacitor and into the discharge inductor and can be used for the next switching cycle. This leads to better efficiency of the circuit. In regard to the discharge into the discharge inductor, which is preferably a coil, it must also be considered that only its d.c. resistance has an effect so that a nearly loss-free transmission of energy takes place.

In one embodiment, an RC element, formed from the parallel circuit of the capacitor and the discharge resistor, determines the discharge time in the discharge frame. The capacitor is discharged on the basis of an exponential function.

It is advantageous that the control unit determines time period for the closure of the additional controllable switch in the discharge frame on the basis of the number of point loads to be switched on in the succeeding control frame. No complete discharge of the capacitor therefore occurs, since the capacitor is discharged only to the voltage at which it would formerly have had to be charged again in the succeeding control frame. This results in a substantial energy saving when using the method, because a total discharge of the capacitor does not take place.

In one embodiment, it is specified that a discharge of the capacitor is carried out only when the number of point loads to be connected in the succeeding control frame is smaller than the number of point loads that had been connected in the preceding control frame. The capacitor is thus discharged or partially discharged only when the number of point loads that will be switched on in the control frame of the succeeding switching cycle is smaller than the number in the control frame of the current switching cycle.

In one embodiment, it is provided that a final discharge voltage to which the capacitor is discharged in the discharge frame is determined, wherein the determination of the final discharge voltage is achieved by adding up the determined voltage drops across the individual point loads that will be switched on in the next control frame. The control unit can thereby calculate the final discharge voltage and the discharge of the capacitor can be performed to an optimum value.

In one embodiment, that the values of the forward voltages of the point loads are analyzed during operation and stored in an associated memory. The changes in the point loads can thereby be acquired over the lifetime of the electrical load, and the control unit can correct the final discharge voltage over the lifetime of the point loads.

In one embodiment, it is provided that at the beginning of the discharge frame the value of the determined final discharge voltage is compared to the capacitor voltage present on the capacitor, and that the discharge process is begun only when the final discharge voltage is smaller than the capacitor voltage present on the capacitor, and that the discharge of the capacitor is interrupted as soon as the final discharge voltage and the capacitor voltage present on the capacitor are equal.

In one embodiment, it is provided that the final discharge voltage of the operating temperature and/or of the life and of the thereby determined aging of the components of the point loads is corrected by permanently measuring the voltage drops across the point loads.

The circuit arrangement can comprise an input capacitor, a control unit, and a driver stage, wherein the control unit and the driver stage are connected in parallel to the input capacitor and an inductor is connected between the input capacitor and the driver stage, wherein the driver stage drives a current through a diode into an electrical load, wherein a parallel circuit comprising a capacitor with a discharge resistor and a controllable switch connected downstream of it are joined to the electrical load, or the capacitor is connected in parallel to the electrical load and another discharge resistor with a controllable switch connected downstream of it embodies a connection between the input capacitor and the capacitor, or the capacitor is connected in parallel to the electrical load and a discharge inductor with another controllable switch connected upstream of it embodies a connection between the input capacitor and the capacitor. In this case, it is advantageous for the method described above to be implemented with a small number of electrical components. Discharge of the capacitor does not occur through the electrical load and its point loads, but the discharge occurs directly through the discharge resistor to ground or to zero point or to another voltage potential or into the input capacitor and/or the discharge inductor.

This prevents the discharge process from damaging the electrical load or one of the point loads. In addition, the energy stored in the capacitor is not annihilated during the discharge into the input capacitor, but is transmitted into the discharge inductor and/or input capacitor and can be used for the next switching cycle. This leads to better efficiency of the circuit arrangement. In regard to the discharge through the discharge inductor, which is preferably a coil, it must also be considered that only its d.c. resistance has an effect so that a nearly loss-free transmission of energy into the input capacitance (input capacitor) takes place.

In one embodiment, it is provided that a diode is connected to ground or to zero point between the discharge inductor and the controllable switch connected upstream of it.

In one embodiment, it is provided that the diode is connected to ground in the reverse direction.

The device can serve for control and discharge control of an electrical load. The electrical load consists of at least two point loads. The control unit uses a driver stage to drive a current into the electrical load, wherein the control unit controls switching cycles for the electrical load, wherein each switching cycle comprises a control frame and a discharge frame. A controllable switch is connected in parallel to each point load so that each point load can be switched in the switching cycle independently of the other point load. The controllable switches can switch on the point loads during the control frame, and the controllable switches can switch off the point loads during the discharge frame.

It is advantageous that the control unit individually switches the point loads on and off in succession or together or in groups and/or that the point loads are connected in series. To this end, the control unit controls the controllable switches individually. It is thereby possible to control the load of the point loads individually. In addition, when LEDs are used as point loads, it is possible to adjust the light emission of the LEDs and thus the brightness of the electrical load to the respective requirements.

It is advantageous that the control unit uses a current measuring unit to monitor the electrical current flowing in the electrical load at a current measuring point and uses a driver stage to adjust it to a controllable setpoint by means of an actual/setpoint comparison, so that a current that is as constant as possible flows into the electrical load. The current flow in the electrical load can thus be kept relatively constant, for example by pulse width modulation.

It is advantageous that driver stage is made of a transistor with its wiring, a field-effect transistor with its wiring or an amplifier with its wiring. Inexpensive standard components can thus be used.

It is advantageous that a point load is a diode array comprising at least two light-emitting diodes connected in parallel and/or connected in series and or matrix-connected. An adjustment of the electrical load can thus be made for each requirement on the lighting.

It is advantageous that a capacitor connected to ground or to zero point or to another voltage potential is in parallel to the electrical load and that a discharge resistor with an additional controllable switch is arranged in parallel to the capacitor, wherein the discharge resistor discharges the capacitor to ground or to zero point or another voltage potential when the controllable switch is closed, or a discharge resistor with a controllable switch connected downstream of it embodies a connection between the input capacitor and the capacitor and the discharge resistor discharges the capacitor into the input capacitor when the controllable switch is closed, or a discharge inductor with a controllable switch connected upstream of it embodies a connection between the input capacitor and the capacitor and discharges the capacitor into the discharge inductor and input capacitor when the controllable switch is closed. In this case it is advantageous that the discharge of the capacitor does not occur through the electrical load and its point loads, but that the discharge occurs directly through the discharge resistor to ground or to zero point or to another voltage potential or into the input capacitor and/or the input inductor.

This prevents the discharge process from damaging or overloading the electrical load or one of the point loads. In addition, the energy stored in the capacitor is not annihilated during the discharge into the input capacitor, but is transmitted into the input capacitor and can be used for the next switching cycle. This leads to better efficiency of the circuit. In regard to the discharge through the discharge inductor, which is preferably a coil, it must also be considered that only its d.c. resistance has an effect so that a nearly loss-free transmission of energy into the input capacitor takes place.

It is advantageous that the control unit determines the time period for the closure of the additional controllable switch in the discharge frame and thus determines the discharge of the capacitor to a defined voltage value on the basis of the number of point loads to be switched on in the control frame of the succeeding switching cycle. Complete discharge of the capacitor therefore does not occur, since the capacitor is discharged only to the voltage at which it would formerly have to be recharged in the succeeding control frame. This results in a substantial energy saving when using this method, because no total discharge of the capacitor takes place.

It is advantageous that the control unit uses, as a basis for its determination of the defined voltage value to which it is to discharge the capacitor, the partial voltage drops across the point loads continuously monitored and stored by the control unit. This makes it possible to acquire the changes in the point loads over the lifetime of the electrical load or point loads respectively, and the control unit can correct the discharge of the capacitor over the lifetime of the point loads.

It is advantageous that the control unit carries out a discharge of the capacitor only when the number of point loads to be connected in the control frame of the succeeding switching cycle is smaller than the number of point loads connected in the control frame of the current switching cycle. Discharge of the capacitor will occur only when it is necessary. This results in an energy saving when operating the device.

In an advantageous embodiment of the device, it is provided that the control unit controls the controllable switches.

The invention will be described in more detail below on the basis of a concrete embodiment example based on FIG. 1-13. This description of the invention on the basis of concrete embodiment examples does not represent any limitation of the invention to one of the embodiment examples.

DETAILED DESCRIPTION OF THE PREFERRED EMBODIMENT

Figure 1:
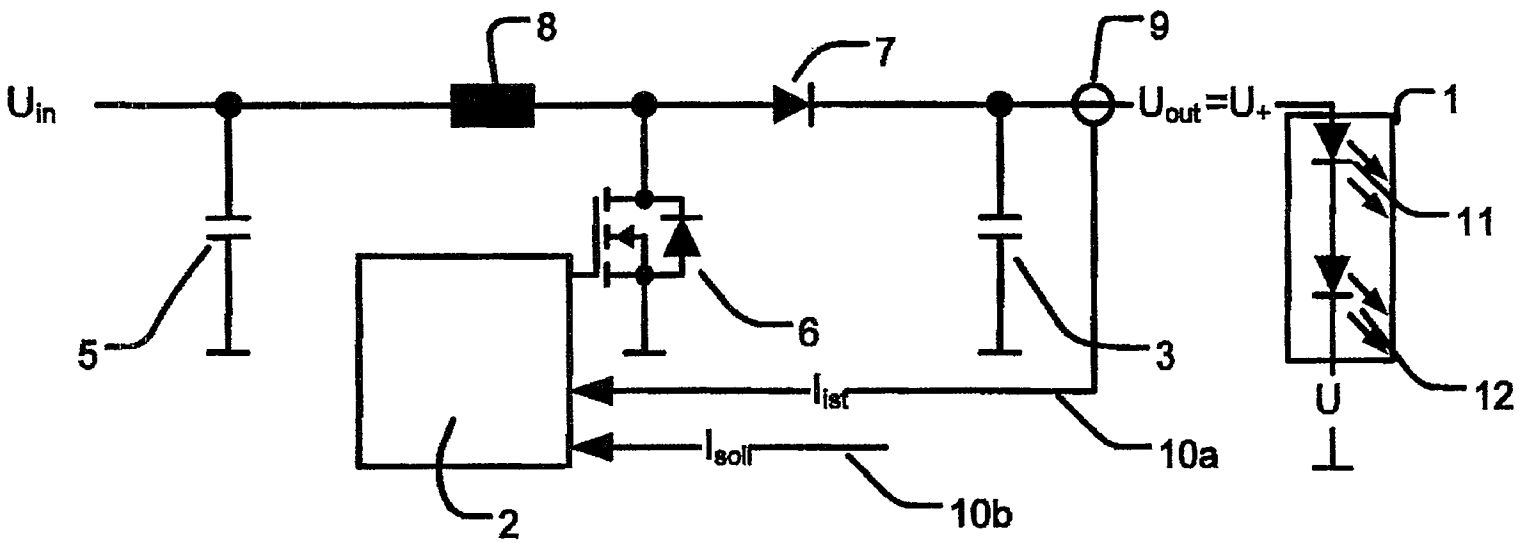
FIG. 1 is a wiring of an electrical load, preferably consisting of LEDs, with a step-up converter.

In the following description of the figures, the same reference characters for identical elements in the figures will be used for all of the figures. This will provide clarity and better understanding of the following concrete description of the invention based on FIG. 1 to FIG. 13.

FIG. 1 depicts a wiring of an electrical load 1 with a step-up converter. The electrical load 1 consists of at least two point loads 11, 12. The point loads 11, 12 each relate to at least one light-emitting diode. Although FIG. 1 represents only two light-emitting diodes connected in series, a nearly arbitrary number of light-emitting diodes can nevertheless be added. In an advantageous manner, it relates to at least two diodes connected in series and/or parallel which are connected as a diode array. But the diode array can also consist of a series connection and/or parallel circuit and/or matrix connection of individual light-emitting diodes.

The electrical load 1 is driven by a current that is supposed to be held nearly constant. The current is driven by a clocked supply, here in the form of a step-up converter formed out of the coil 8, the diode 7 and the switching element 6, here in the form of a field-effect transistor, and by the feedback control 2. A control unit 2, which uses a current measuring unit to determine the current intensity at a current measuring point 9 and properly controls the current in accordance with the setpoint on the basis of a setpoint/actual-value comparison; controls the current. The control unit 2 feeds the setpoint and the actual value through the ports 10*a* and 10*b*. The adjustment can then be accomplished using a comparing element or a comparator.

A capacitor 3 is connected in parallel to the electrical load 1. Furthermore, an input capacitor 5, which like the capacitor 3 and control unit 2 is connected to ground or to zero point or to another voltage potential, is provided. The input voltage $U_{in}$ is on the input side; The voltage $U_{out}$ decreases across electrical load 1.

If the electrical load 1 is now switched on, then a nearly constant controlled current flows into the electrical load 1 and the point loads 11, 12. If the point loads 11, 12 are switched off, then the capacitor 3 has a voltage that must be discharged, particularly reduced, when the load changes during a new closing operation. The discharge then occurs through the electrical load 1, which is still connected but no longer supplied with current. This discharge can then cause damage to the electrical load if this discharge is not monitored and coordinated.

Figure 2:
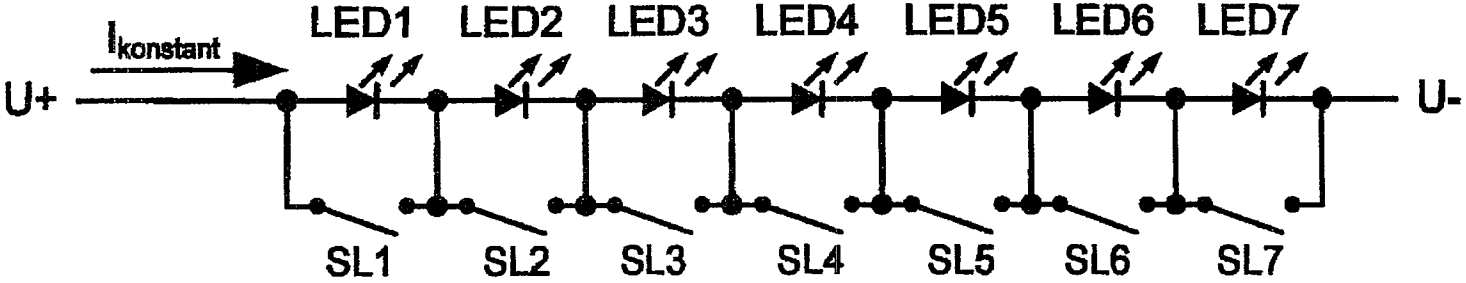
FIG. 2 is a series connection of individual LEDs.

FIG. 2 depicts a series connection of LEDs LED1, LED2, LED3, LED4, LED5, LED6, LED7. Each of the LEDs LED1, LED2, LED3, LED4, LED5, LED6, LED7 corresponds to a point load in FIG. 1. To now individually switch each of the LEDs LED1, LED2, LED3, LED4, LED5, LED6, LED7 on and off in a series connection of LEDs LED1, LED2, LED3, LED4, LED5, LED6, LED7 of this type, a controllable switch SL1, SL2, SL3, SL4, SL5, SL6, SL7 is connected in parallel to each of the LEDs LED1, LED2, LED3, LED4, LED5, LED6, LED7. One LED LED1, LED2, LED3, LED4, LED5, LED6, LED7 is switched off by closing its controllable switch SL1, SL2, SL3, SL4, SL5, SL6 SL7 and thus bypassing the LED. In this way, each of the individual LEDs LED1, LED2, LED3, LED4, LED5, LED6, LED7, which then form an LED array, can be switched independently of each of the other LEDs LED1, LED2, LED3, LED4, LED5, LED6, LED7. In this way, it is possible to switch the individual LEDs LED1, LED2, LED3, LED4, LED5, LED6, LED7 on and/or off in sequence and/or together.

Any mechanical contact as well as any type of semiconductor switch will serve as controllable switch SL1, SL2, SL3, SL4, SL5, SL6 SL7. In a preferred embodiment, the controllable switches SL1, SL2, SL3, SL4, SL5, SL6, SL7 can be electronically controlled and switched, wherein control unit 2 provides the control.

As a rule, the LEDs LED1, LED2, LED3, LED4, LED5, LED6, LED7 are switched on and/or off according to a particular scheme. To this end, a control frame is first defined. This control frame is repeated cyclically at a frequency. Through the skillful choice of the repetition frequency, the human eye will integrate the emitted amount of light. Typical frequencies of this type are near 100 Hz to 200 Hz. Within one control frame, control unit 2 uses the controllable switches SL1, SL2, SL3, SL4, SL5, SL6 SL7 to trigger only those LEDs LED1, LED2, LED3, LED4, LED5, LED6, LED7 that have a turn-on time corresponding to the brightness requirement for the current operating method.

Various procedures can be used to coordinate the various switch-on times and the closing operation. For sake of example, FIG. 3 to FIG. 5 depict various possible procedures for switching the LEDs on and off.

Figure 3:
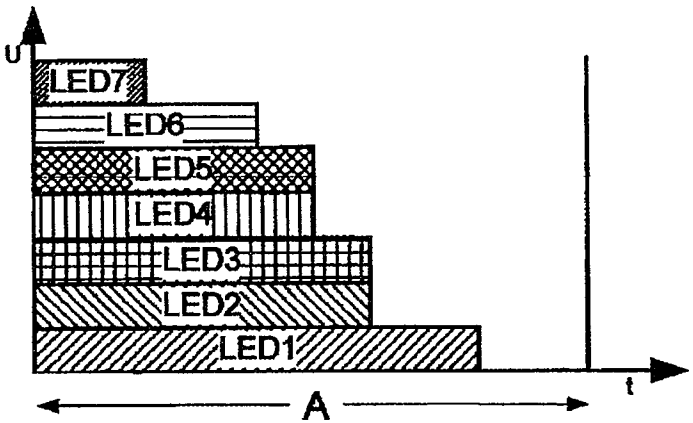
FIG. 3 is a control frame for LEDs.
Figure 4:
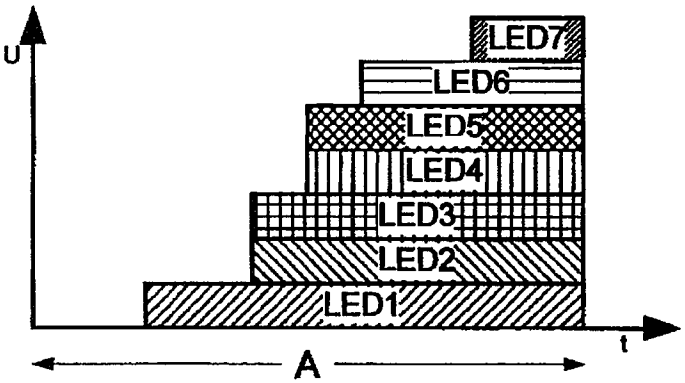
FIG. 4 is a control frame for LEDS.

FIG. 3 depicts a diode array consisting of seven LEDs LED1, LED2, LED3, LED4, LED5, LED6, LED7 connected in series. It represents the simultaneous closing operations on seven LEDs LED1, LED2, LED3, LED4, LED5, LED6, LED7 connected in series. All seven LEDs LED1, LED2, LED3, LED4, LED5, LED6, LED7 are closed simultaneously at the beginning of control frame A and again switched off during control frame A. In FIG. 3, the seventh LED LED7 is the first to again be switched off. Subsequently, the sixth LED LED6 is switched off. After that, the fifth and fourth LEDs LED5, LED4 are switched off together and subsequently the third and second LEDs LED3, LED2 and finally the first LED LED1. The diode array is again dark.

FIG. 4 again depicts a diode array having seven LEDs LED1, LED2, LED3, LED4, LED5, LED6, LED7 connected in series. The figure illustrates staggered closing operations on the individual LEDs LED1, LED2, LED3, LED4, LED5, LED6, LED7 in a timing sequence within control frame A. At the end of control frame A, all seven LEDs LED1, LED2, LED3, LED4, LED5, LED6, LED7 are switched off together.

Figure 5:
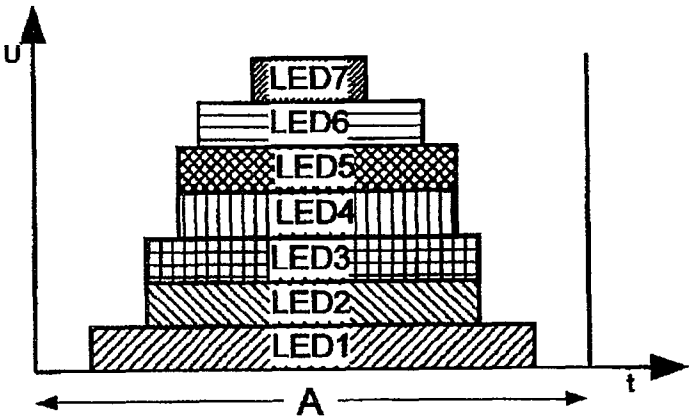
FIG. 5 is a control frame for LEDs.

Another possibility of controlling LEDs is represented by a combination of staggered closing operations and disconnections as illustrated in FIG. 5 for sake of an example. FIG. 5 depicts a diode array having seven LEDs LED1, LED2, LED3, LED4, LED5, LED6, LED7 connected in series. The figure illustrates staggered closing operations and disconnections of the individual LEDs LED1, LED2, LED3, LED4, LED5, LED6, LED7 within control frame A.

Problematic in the variation of switch-on and switch-off times of the individual LEDs, especially the switch-off times, is that the respective output capacitance, say capacitor 3, must be discharged. Discharge occurs through the connected load 1 and the point loads 11, 12 which are still connected and operated.

Figure 6:
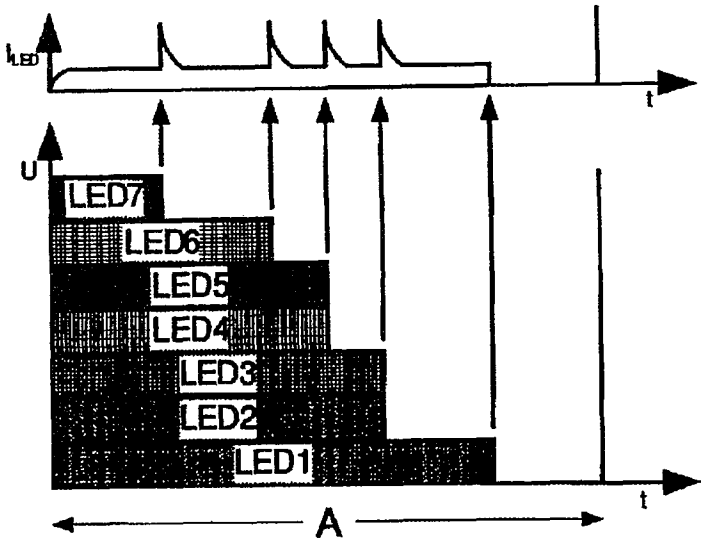
FIG. 6 is a control frame for LEDs.

For sake of example, FIG. 6 therefore illustrates the current peaks that arise if the seven LEDs LED1, LED2, LED3, LED4, LED5, LED6, LED7 as depicted in FIG. 3 are switched off. A disconnection of one of the LEDs LED1, LED2, LED3, LED4, LED5, LED6, LED7 leads to a brief current rise, a current peak. After the seventh LED LED7 is switched off, this causes an "excessive" current, i.e. a current peak, to briefly flow through the other six LEDs LED1, LED2, LED3, LED4, LED5, LED6, which are still connected, and this current peak could possibly lead to damage or to overloading of LEDs LED1, LED2, LED3, LED4, LED5, LED6.

Figure 7:
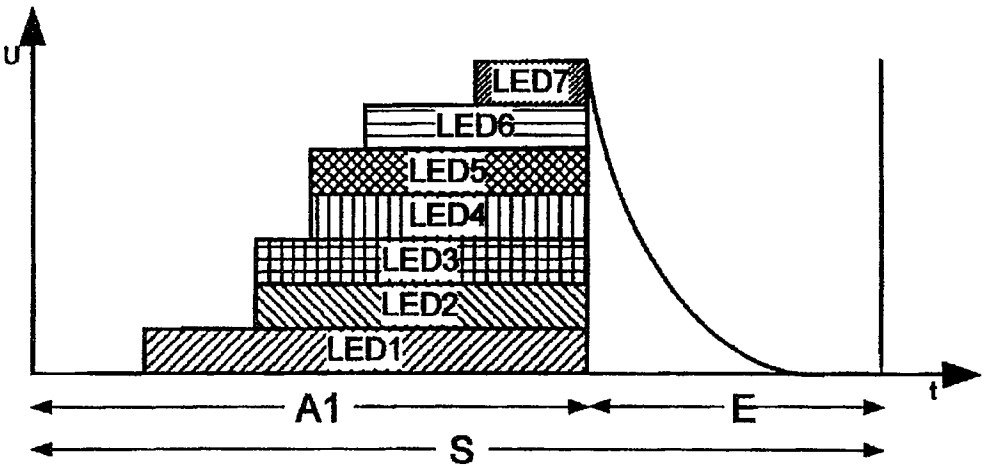
FIG. 7 is a switching cycle with control and discharge frames.

FIG. 7 depicts an effective course of action to prevent these current peaks. It again illustrates a light-emitting diode array having seven LEDs LED1, LED2, LED3, LED4, LED5, LED6, LED7 connected in series. But it indicates a discharge frame E in addition to the control frame A1. The LEDs LED1, LED2, LED3, LED4, LED5, LED6, LED7 are switched on in control frame A1. The closing operation proceeds in correspondence with the closing operation depicted in FIG. 4. The control frame A1 and the discharge frame E together form a switching cycle S. In the usual operating method of electrical load 1, a plurality of switching cycles S follow one another. The individual point loads 11, 12, in FIG. 7 the LEDs LED1, LED2, LED3, LED4, LED5, LED6, LED7, are correspondingly controlled and switched on in control frame A1 by opening the controllable switches, as illustrated in FIG. 2. The discharge of the capacitor 3 illustrated in FIG. 1 occurs in the discharge frame E.

Figure 8:
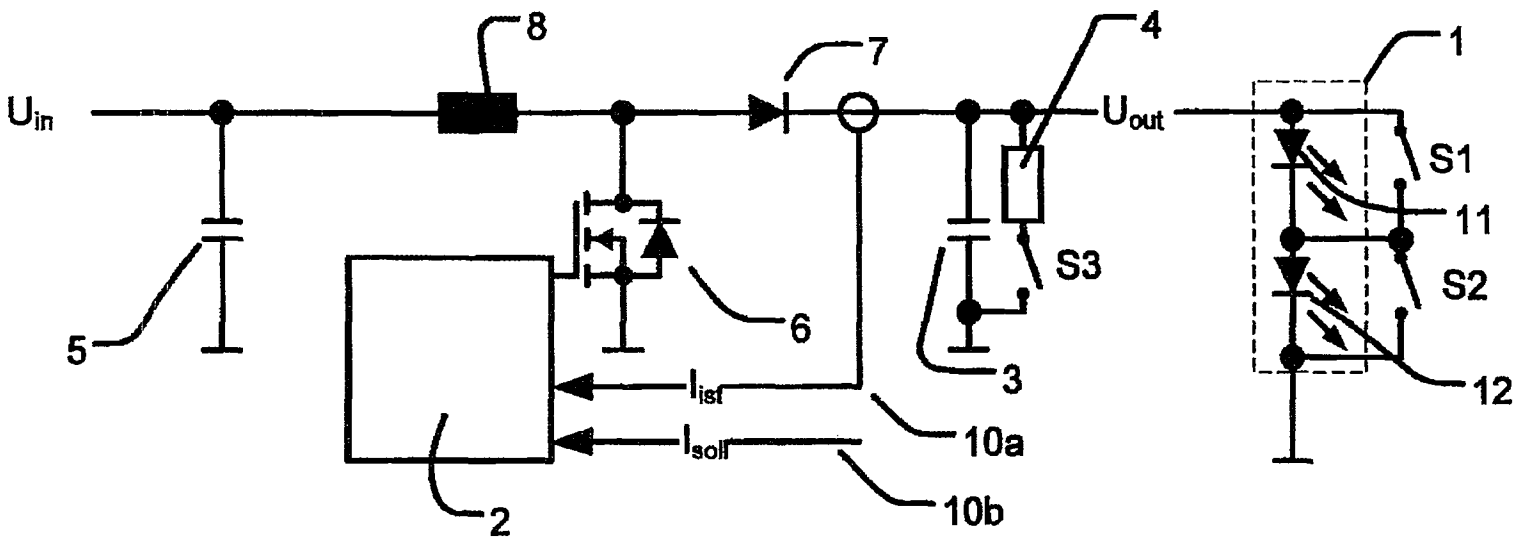
FIG. 8 is an embodiment of the device according to the invention.

FIG. 8 depicts a circuit that allows capacitor 3 to be discharged during discharge frame E. The circuit of FIG. 8 modifies the circuit of FIG. 1 by a discharge resistor 4, which is connected in parallel to capacitor 3 and can be connected to ground or to zero point or to another voltage potential by a controllable switch S3. In addition, each point load 11, 12 in FIG. 8 is provided with a controllable switch S1, S2, which is connected in parallel to the point load 11, 12.

The discharge resistor 4 is provided so that the capacitor 3 does not have to be discharged through the electrical load 1. The controllable switch S3 is opened during control frame A1, and the controllable switch S3 is closed during discharge frame E. The capacitor 3 and the electrical energy accumulated there is discharged through the discharge resistor 4 to ground or to zero point or to the negative supply voltage by closing the controllable switch S3. The discharge occurs in accordance with an exponential function with the time constant consisting of the capacitance value of capacitor 3 and the resistance value of discharge resistor 4.

A fixed time for the discharge leads to possibility of the voltage on capacitor 3 dropping further if this drop is required in the next control frame A1 of the succeeding switching cycle. If, for example, the first control frame A1, which has an LED voltage of seven LEDs, terminates and it is necessary to switch on four LEDs in the control frame of the succeeding switching cycle, then the energy that was effected during a complete discharge of capacitor 3 must again be gathered.

It is therefore advantageous to define a discharge voltage, hereinafter called discharge forward voltage, to which capacitor 3 is discharged. The discharge forward voltage corresponds to the forward voltage of the LEDs to be switched on in the control frame A1 of the next switching cycle.

At the same time, it is possible to compensate for a time spread of the tolerances of the components of electrical load 1 or of the point loads 11, 12. The discharge forward voltage is also provided for this. To this end, the forward voltages of the individual point loads 11, 12 are analyzed and the values of the forward voltages of the point loads 11, 12, which are supposed to be switched on in the control frame of the next switching cycle S, are added up. The sum of this addition yields the discharge forward voltage. This value is compared to the capacitor voltage on capacitor 3. The discharge process of capacitor 3 is discontinued as soon as the voltages are equal. A permanent measurement of the LED forward voltages also makes it possible to correct the discharge forward voltage over the lifetime and to correct the temperature.

Figure 9:
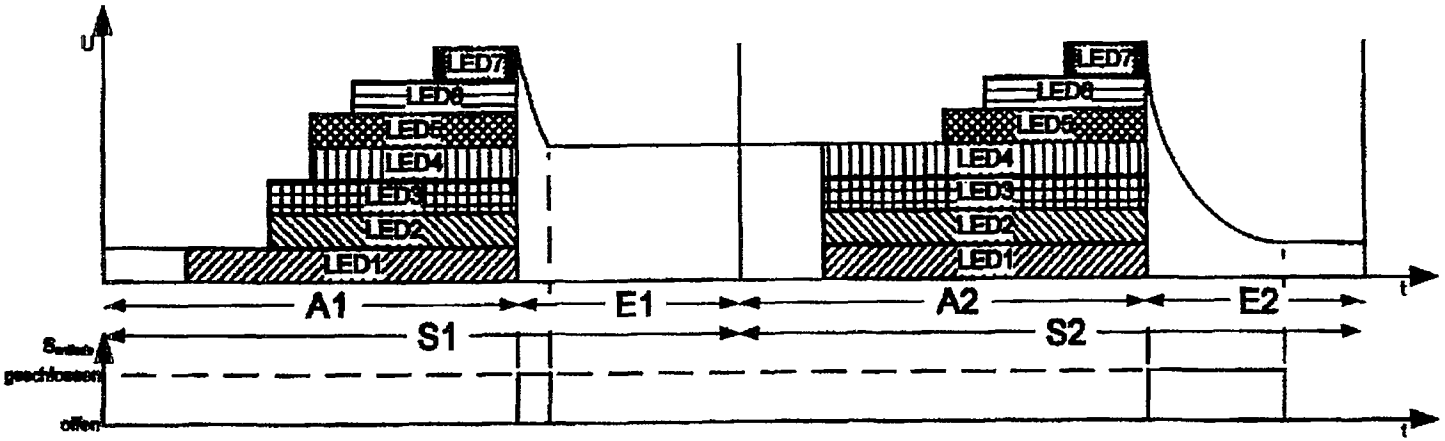
FIG. 9 is two switching cycles following one another.

FIG. 9 accordingly depicts the above method. It represents two switching cycles S1 and S2. The electrical load 1 consists of seven LEDs LED1, LED2, LED3, LED4, LED5, LED6, LED7 connected in series, in correspondence with FIG. 2. Switching cycle S1 features the control frame A1 and discharge frame E1, switching cycle S2 the control frame A2 and discharge frame E2.

The seven LEDs LED1, LED2, LED3, LED4, LED5, LED6, LED7 are switched on in control frame A1 of switching cycle S1 in correspondence with FIG. 4. All seven LEDs LED1, LED2, LED3, LED4, LED5, LED6, LED7 are to be switched off together at the end of control frame A1. Capacitor 3 would then have to be discharged in discharge frame E1. But since four LEDs LED1, LED2, LED3, LED4 are to be switched on in the succeeding switching cycle S2 in its control frame A2, a completely discharged capacitor 3 would first have to be charged to the voltage that drops across the four LEDs LED1, LED2, LED3, LED4. To avoid this and not discharge capacitor 3 completely, the discharge forward voltage is first determined by adding the forward voltages of the first four LEDs LED1, LED2, LED3, LED4 that will be connected first in control frame A2 of switching cycle S2. In the preceding discharge frame E1, the capacitor 3 is therefore discharged to the voltage value that corresponds to the forward voltage of the four LEDs LED1, LED2, LED3, LED4 to be switched on next. An energy loss and a continuous complete discharging and recharging of capacitor 3 is avoided in this manner.

Figure 10:
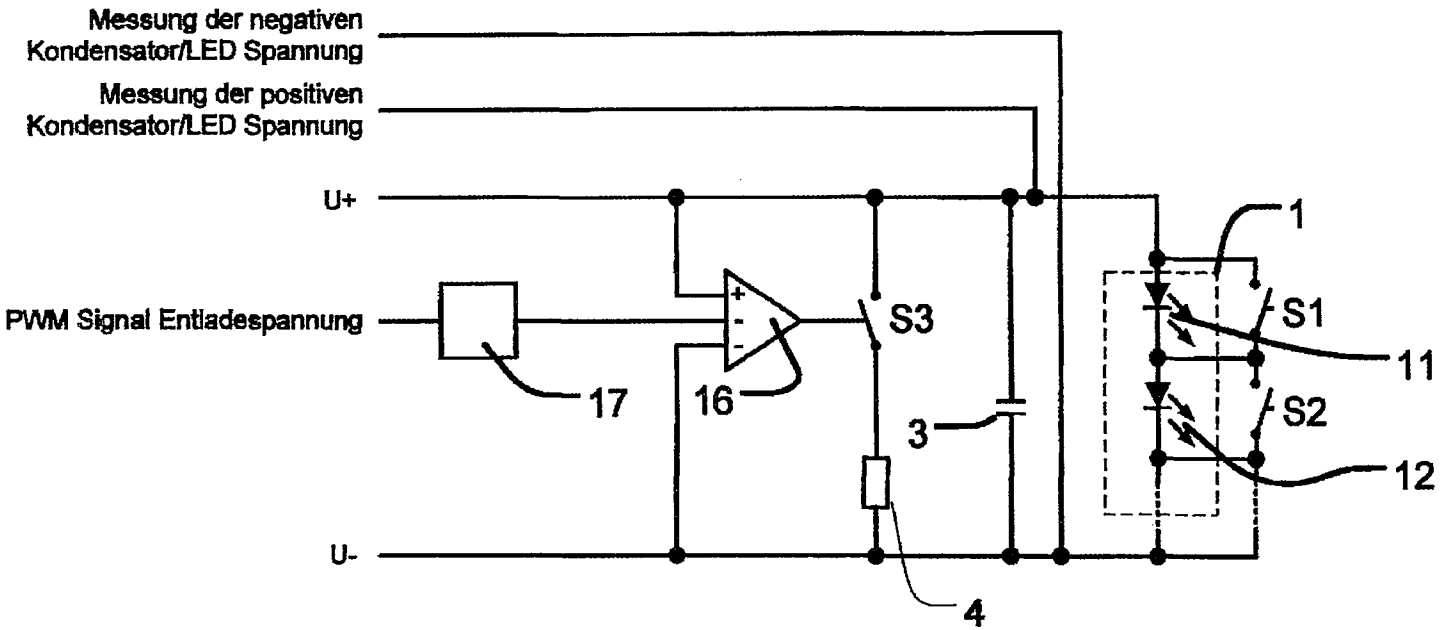
FIG. 10 is a discharge circuit.

FIG. 10 illustrates a corresponding discharge circuit for sake of example. The circuit arrangement represented in FIG. 8 is modified in FIG. 10 insofar as a comparator 16 directly controls the controllable switch S3. The capacitor 3 is discharged through the discharge resistor 4 when the controllable switch S3 is closed. The voltage $U_+$ and the voltage $U_-$, which corresponds to the forward voltage of the LEDs and therefore the charging voltage of capacitor 3, serve as input signals for the comparator 16. The voltage value to which capacitor 3 is to be discharged is also fed to comparator 16. This signal is fed as a pulse-width modulated signal that is conducted through a low-pass filter 17.

Figure 11:
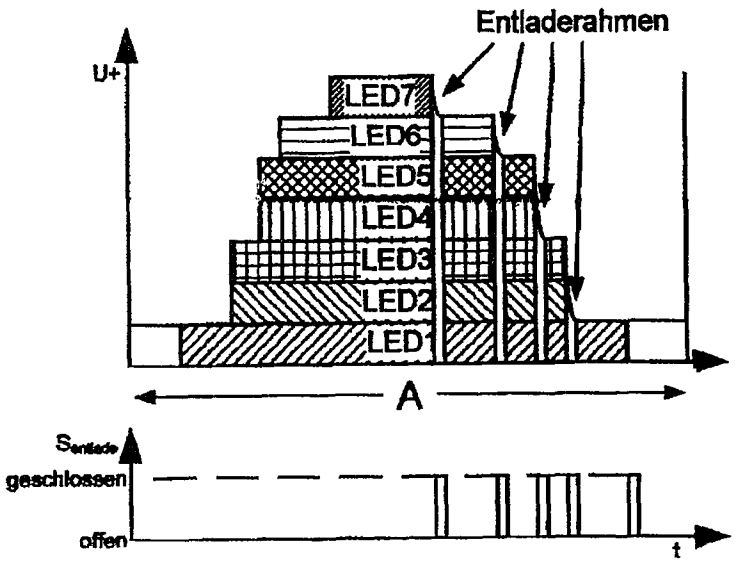
FIG. 11 is a control of a plurality of LEDS with distributed discharge.

FIG. 11 illustrates another possibility for discharging capacitor 3. A brief discharge process for capacitor 3 follows each disconnection of one of the LEDs LED1, LED2, LED3, LED4, LED5, LED6, LED7.

Figure 12:
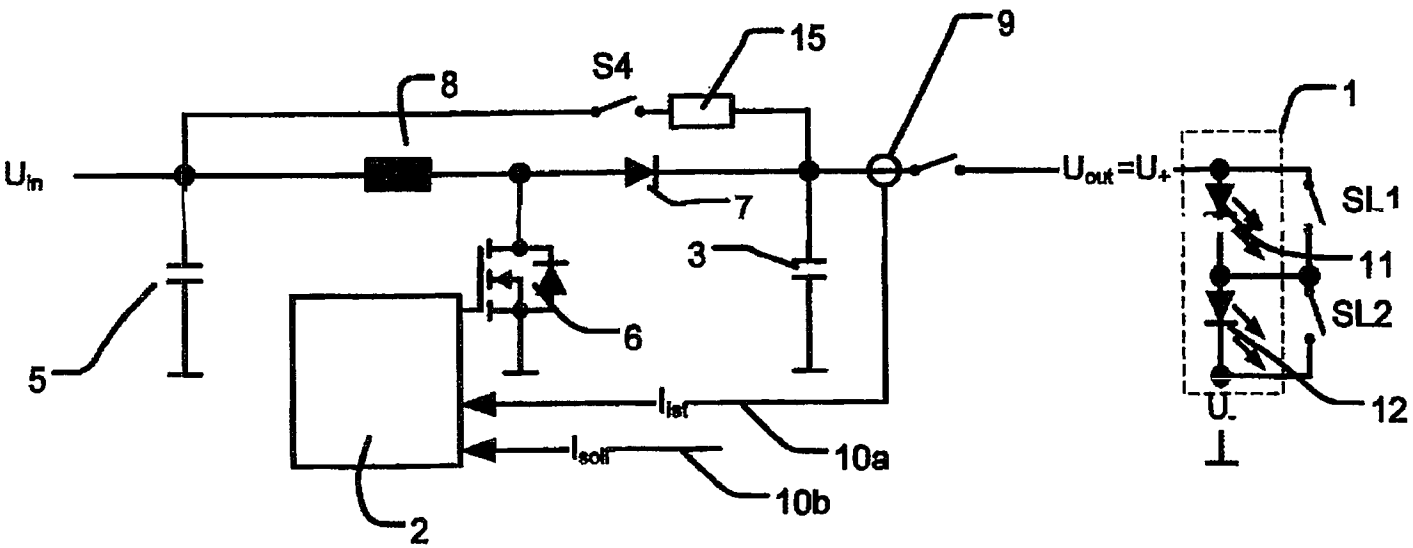
FIG. 12 is a device according to the invention.

FIG. 12 represents a particularly advantageous embodiment of the device. FIG. 12 illustrates a circuit that allows capacitor 3 to be discharged during discharge frame E. The circuit of FIG. 12 modifies the circuit of FIG. 1 in that a discharge resistor 15 with a controllable switch S4 connects the input capacitor 5 and the capacitor 3. In this case, the discharge voltage to which the capacitor 3 is to be discharged is not discharged to ground or to zero point or to another voltage potential but is transmitted to input capacitor 5. This occurs when the controllable switch S4 is closed since the voltage on capacitor 3 is then discharged through the discharge resistor 15 to the input capacitor 5. The energy is therefore not lost. The input voltage $U_{in}$ increases when capacitor 3 is discharged. The boosting of the input voltage $U_{in}$ thereby effected thus results in a lower power loss. 0

Figure 13:
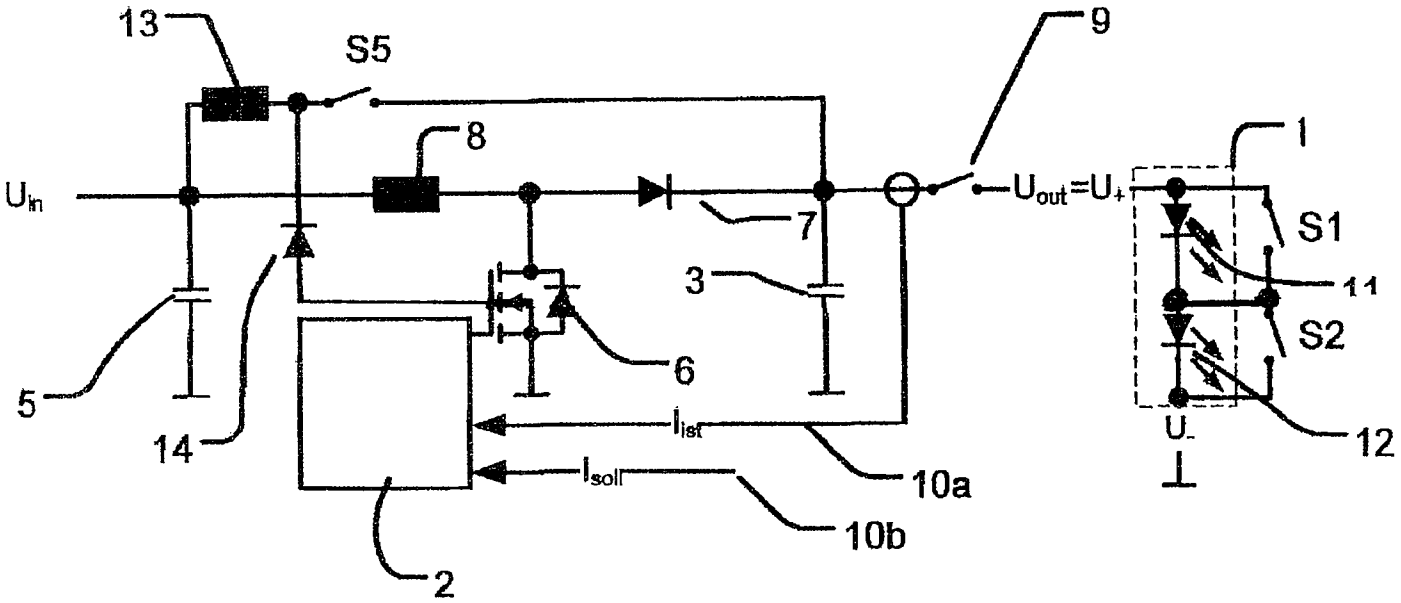
FIG. 13 is an additional device according to the invention.

FIG. 13 represents an alternative embodiment of the device in FIG. 12, wherein the discharge resistor is replaced by a discharge inductor 13, preferably a coil. In FIG. 13, however, the discharge inductor 13 and the controllable switch S5 are exchanged for the discharge resistor 15 and the controllable switch S4 of FIG. 12. In addition, a diode connected in the reverse direction between the controllable switch S5 and the discharge inductor 13 is connected to ground. It is advantageous in the embodiment of the device as per FIG. 13 that only the d.c. resistance of the discharge inductor 13 has an effect when the controllable switch S5 is closed.

What is claimed is:

1. Method for control and discharge control of an electrical load comprising:

at least two point loads by means of a control frame and a discharge frame, wherein one control frame and one discharge frame establish one switching cycle for the electrical load and a plurality of switching cycles are arranged together, wherein a controllable switch is connected in parallel to each point load so that each point load is configured to be switched independently of the other point load during the switching cycle, wherein the electrical current flowing in the electrical load is monitored by a control unit and controlled to an adjustable setpoint by means of an actual/setpoint comparison so that a current that is substantially constant flows into the electrical load, and wherein the controllable switches switch on the point loads during the control frame, and the controllable switches switch off the point loads during the discharge frame, a capacitor connected in parallel to the electrical load smoothes the voltage dropping across the electrical load, and a discharge resistor with an additional controllable switch is connected in parallel to the capacitor in order to discharge the capacitor during the discharge frame by closing the additional controllable switch to ground or to zero point or to another voltage potential through the discharge resistor.

2. Method according to claim 1, wherein the point loads are individually switched on or off in succession or together or in groups and/or that the point loads are connected in series.

3. Method according to claim 1, wherein a point load is formed by a diode array, which comprises at least two light-emitting diodes connected in at least one of (a) parallel, (b) in series, or (c) matrix-connected, forms a point load or that the point load is one light-emitting diode.

4. Method according to claim 1, wherein an input capacitor, which is connected in parallel to the electrical load and control unit, is connected to the capacitor by a discharge resistor and an additional controllable switch, so that a discharge of the capacitor occurs into the input capacitor when the additional controllable switch is closed, thereby increasing an input voltage.

5. Method according to claim 1, wherein an input capacitor, which is connected in parallel to the electrical load and control unit, is connected to the capacitor by a discharge inductor and an additional controllable switch, so that a discharge of the capacitor occurs into and/or through the input inductor and/or into the input capacitor when the additional controllable switch is closed, thereby increasing an input voltage.

6. Method according to claim 1, wherein an RC element, formed from the parallel circuit of the capacitor and the discharge resistor, determines the discharge time in the discharge frame and the capacitor is discharged on the basis of an exponential function.

7. Method according to claim 1, wherein the control unit determines time period for the closure of an additional controllable switch in the discharge frame on the basis of the number of point loads to be switched on in the succeeding control frame.

8. Method according to claim 3, wherein a discharge of the capacitor is carried out only when the number of point loads to be connected in the succeeding control frame is smaller than the number of point loads that had been connected in the preceding control frame.

9. Method according to claim 8, wherein a final discharge voltage to which the capacitor is discharged in the discharge frame is determined, wherein the determination of the final discharge voltage is achieved by adding up the determined voltage drops across the individual point loads that will be switched on in the next control frame.

10. Method according to claim 1, wherein the forward voltage of the point loads is analyzed during operation and stored in an associated memory.

11. Method according to claim 1, wherein at the beginning of the discharge frame, the value of the determined final discharge voltage is compared to a capacitor voltage present on the capacitor, and that the discharge process is begun only when the final discharge voltage is smaller than the capacitor voltage present on the capacitor, and that the discharge of the capacitor is interrupted as the final discharge voltage and the capacitor voltage present on the capacitor are equal.

12. Method according to claim 1, wherein the final discharge voltage is corrected over the operating temperature and life of the point loads by permanently measuring the voltage drops across the point loads.

13. Circuit arrangement for carrying out the method according to claim 1, comprising:

an input capacitor, a control unit and a driver stage, wherein the control unit and the driver stage are connected in parallel to the input capacitor and an inductor is connected between the input capacitor and the driver stage, wherein the driver stage drives a current through a diode into an electrical load, and wherein a parallel circuit comprising the capacitor with a discharge resistor and a controllable switch connected downstream of it are joined to the electrical load, or the capacitor is connected in parallel to the electrical load and another discharge resistor with a controllable switch connected downstream of it embodies a connection between the input capacitor and the output capacitor, or the capacitor is connected in parallel to the electrical load and a discharge inductor with a controllable switch connected upstream of it embodies a connection between the input capacitor and the output capacitor.

14. Circuit arrangement according to claim 13, wherein a diode is connected to ground between the discharge inductor and the controllable switch connected upstream of it.

15. Circuit arrangement according to claim 14, wherein the diode is connected to ground in the reverse direction.

16. Device for control and discharge control of an electrical load comprising:

at least two point loads by means of a control unit, which uses a driver stage to drive a current into the electrical load, wherein the control unit controls switching cycles for the electrical load, wherein each switching cycle comprises a control frame and a discharge frame, a controllable switch is connected in parallel to each point load so that each point load can be switched in the switching cycle independently of the other point load, and wherein the controllable switches are configured to switch on the point loads during a control frame, and the controllable switches are configured to switch off the point loads during the discharge frame, and wherein a capacitor is in parallel to the electrical load and a discharge resistor with an additional controllable switch is arranged in parallel to the capacitor, wherein the discharge resistor discharges the capacitor to ground or to zero point or another voltage potential when the controllable switch is closed, or a discharge resistor with a controllable switch connected downstream of it embodies a connection between the input capacitor and the capacitor and the discharge resistor discharges the capacitor into the input capacitor when the controllable switch is closed, or a discharge inductor with a controllable switch connected upstream of it embodies a connection between an input capacitor and the capacitor and discharges the capacitor into the discharge inductor and input capacitor when the controllable switch is closed.

17. Circuit arrangement according to claim 16, wherein the control unit individually switches the point loads on and off in succession or together or in groups and/or that the point loads are connected in series.

18. Circuit arrangement according to claim 16, wherein the control unit uses a current measuring unit to monitor the electrical current flowing in the electrical load at a current measuring point and uses the driver stage to adjust it to a controllable setpoint by means of an actual/setpoint comparison, so that a current that is as constant as possible flows into the electrical load.

19. Circuit arrangement according to claim 16, wherein the driver stage is made of a transistor with its wiring, a field-effect transistor with its wiring or an amplifier with its wiring.

20. Circuit arrangement according to claim 16, wherein the a point load is a diode array comprising at least two light-emitting diodes connected in parallel and/or connected in series and or matrix-connected.

21. Device according to claim 16, wherein the control unit determines the time period for the closure of an additional controllable switch in the discharge frame and thus determines the discharge of the capacitor to a defined voltage value on the basis of the number of point loads to be switched on in the control frame of the succeeding switching cycle.

22. Device according to claim 21, wherein the control unit uses, as a basis for its determination of the defined voltage value to which it is to discharge the capacitor, the partial voltage drops across the point loads continuously monitored and stored by the control unit.

23. Device according to claim 22, wherein the control unit carries out a discharge of the capacitor only when the number of point loads to be connected in the control frame of the succeeding switching cycle is smaller than the number of point loads connected in the control frame of the current switching cycle.

24. Device according to claim 23, wherein the control unit controls the controllable switches.

* * * * *